US006780036B2

(12) United States Patent
Osada

(10) Patent No.: US 6,780,036 B2
(45) Date of Patent: Aug. 24, 2004

(54) ELECTRICAL CONNECTOR ASSEMBLY COMPRISING LOCKING PART

(75) Inventor: Tsuyoshi Osada, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/176,713

(22) Filed: Jun. 20, 2002

(65) Prior Publication Data

US 2002/0197897 A1 Dec. 26, 2002

(30) Foreign Application Priority Data

Jun. 22, 2001 (JP) ..... 2001-189118

(51) Int. Cl.[7] ..... H01R 13/703
(52) U.S. Cl. ..... 439/188; 201/51.1
(58) Field of Search ..... 439/188, 352, 439/350, 357, 509, 512, 510, 514, 515; 200/51.1, 51.09

(56) References Cited

U.S. PATENT DOCUMENTS 5,275,575 A 1/1994 Cahaly et al.
5,516,299 A * 5/1996 Fukuda et al. ..... 439/188
6,364,683 B1 * 4/2002 Kohno ..... 439/352

FOREIGN PATENT DOCUMENTS

JP 2647336 5/1997

OTHER PUBLICATIONS

Patent Abstracts of Japan, Publication No. 06–208867, Jul. 26, 1994, 1 pg.

* cited by examiner

*Primary Examiner*—Alex Gilman
(74) *Attorney, Agent, or Firm*—Osha & May L.L.P.

(57) ABSTRACT

An electrical connector assembly of the present invention comprises (1) a socket for supporting two pairs of first electrical connector elements in proximity; (2) a plug for supporting two pairs of second electrical connector elements, which are to be engaged with the two pairs of first electrical connector elements, respectively; (3) two short-circuit elements, fitted in the socket, for electrically short-circuit the two pairs of first electrical connector elements, respectively; and (4) a locking element which is locked at a first position with respect to the plug and, when the plug is engaged in the socket, becomes movable to a second position at which the locking element forces the two short-circuit elements to move back to their non-short-circuit positions simultaneously. This can provide an electrical connector assembly having a locking part that can provide a drastically improved working efficiency and thus provide excellent connection workability even when two pairs of electrical contacts are connected with each other.

4 Claims, 17 Drawing Sheets

ELECTRICAL CONNECTOR ASSEMBLY COMPRISING LOCKING PART

BACKGROUND OF THE INVENTION

1. Technical Field of the Invention

The present invention belongs in a technical field of an electrical connector assembly. Particularly, the present invention relates to an electrical connector assembly wherein a plug is provided with a locking element which permits electrical contact points of a socket to be short-circuited with each other when the socket and the plug are not adequately connected with each other and permits the short-circuit to be released when they are adequately connected with each other.

2. Description of the Prior Art

An airbag system comprises an airbag assembly and an electric or electronic control system which are assembled in a hidden compartment of a driver's cabin of a vehicle. The control system is connected with the airbag assembly via a wire harness. The wire harness is provided with a typical electrical plug and socket connector assembly, to allow a simple way for the airbag assembly and the control system to be electrically interconnected after assembled separately.

This connector assembly is provided with a so-called short-circuit clip. The short-circuit clip is a small metal element arranged in such a manner that the wires can be electrically short-circuited with each other within the plug or socket before the plug and the socket are engaged. The short-circuit clip is arranged as a safety device to prevent improper operation of the airbag assembly caused by leakage of electrical charge or improper connection in the course of production.

When the connector assembly is accurately connected, the safety device using the short-circuit clip for electrical short circuit must be shifted to a non-short-circuit position. U.S. Pat. No. 5,275,575 and JP Patent No. 2647336 disclose the electrical connector assembly with locking element which is so designed as to release the electrical short circuit provided by the safety device. This electrical connector assembly is so structured that it does not operate until the plug and the socket are both put in their completely engaged position and the locking element is shifted to its locked position. Also, the locking element serves to prevent the plug and the socket from being disconnected accidentally after combined.

The airbag systems using this electrical connector assembly take much account of inflation properties and like aspects of the airbag assembly. In view of this, some of the airbag systems in recent years have two igniters for each airbag, for energizing and igniting a gas generator to inflate the airbag. This type of airbag system requires two pairs of electrical contacts and it takes the formation that the two electrical connector assemblies are placed in proximity, as disclosed by JP Patent No. 2647336.

However, this type one requires a two-step motion for fitting the connector assemblies. It also requires that the connector assemblies be distinguished by using different colors or shapes, in order to prevent improper connection of those two connector assemblies. Further, it requires the confirmation of the fitting position of the connector assemblies. Also, because of working space limitations in the fitting position of the connector assemblies, the confirmation of the fitting position must be done with difficulty, thus presenting the problem with workability. In addition, Effective use of the connection space requires the work that the two sockets are placed in position while making a position adjustment to bring the electrical contacts of each pair into alignment in series in each of the sockets.

In the case of the electrical connector assembly described in JP Patent No. 2647336, for bringing the electrical connector assembly into the completely connected state, a two-step motion is required comprising the first step motion of engaging the plug and the socket with each other and the second step motion of inserting the locking element into the both components to its locked position. Also, the locking element is integrally mounted on either of the plug and the socket via a flexible arm. Because of this, the either of the plug and the socket is increased in size, thus making it hard to handle the electrical connector assembly.

SUMMARY OF THE INVENTION

It is the primary object of the present invention to provide an electrical connector assembly having a locking part that can provide an improved working efficiency and thus provide excellent connection workability even when two pairs of electrical contacts are connected with each other.

In accordance with one aspect of the invention, there is provided an electrical connector assembly comprising: (1) a socket for supporting two pairs of first electrical connector elements in proximity; (2) a plug for supporting two pairs of second electrical connector elements which are to be engaged with the two pairs of first electrical connector elements, respectively; (3) two short-circuit elements, fitted in the socket, for electrically short-circuit the two pairs of first electrical connector elements, respectively; and (4) a locking element which is locked at a first position with respect to the plug and, when the plug is engaged in the socket, becomes movable to a second position at which the locking element forces the two short-circuit elements to move back to their non-short-circuit positions simultaneously.

According to this construction, since the socket is constructed to support the two pairs of first electrical connector elements in proximity, the two sockets can be so arranged that the electrical contacts of each pair can be aligned in series. This can provide the result of facilitating the effective use of the connection space.

Also, since the plug is constructed to support the two pairs of second electrical connector elements as a unit, the double action commonly required for the engagement of the connector assembly can be reduced in half to the single operation.

Further, since the socket and the plug can be engaged with each other in only a limited orientation, the need to distinguish the two connector assemblies by using different colors or shapes for the purpose of preventing improper connection of the two connector assemblies is eliminated to begin with. In addition, the need to check the fitting positions of the connector assemblies is eliminated to begin with. Thus, in addition to reducing a component count, additional works, such as the color coding, and the checking work of the fitting positions can be cut.

Also, since the integrally formed locking element can allow the two short-circuit elements to move back to their non-short-circuit positions simultaneously, the release of short-circuit can be completed in only a single operation.

Thus, the present invention can provide an electrical connector assembly having a locking part that can provide a drastically improved working efficiency and thus provide excellent connection workability even when two pairs of electrical contacts are connected with each other.

These and other objects, features and advantages of the invention will become more apparent upon a reading of the following detailed specification with reference to the accompanying drawings.

DETAILED DESCRIPTION OF THE PREFERRED EMBODIMENT

In the following, an embodiment of the present invention will be described. It is to be noted that only a certain preferred embodiment of the present invention is shown for convenience of explanation and is not to be construed as limiting the present invention.

The present invention is particularly suitably applicable to an airbag system for restraining vehicle occupants and, accordingly, the application to the airbag system is illustrated here as an example of the preferred embodiments of the present invention. It is to be understood, however, that the present invention is applicable within a wider range for various different environments and various intended objects, without limiting to the application to the airbag system.

Figure 1:
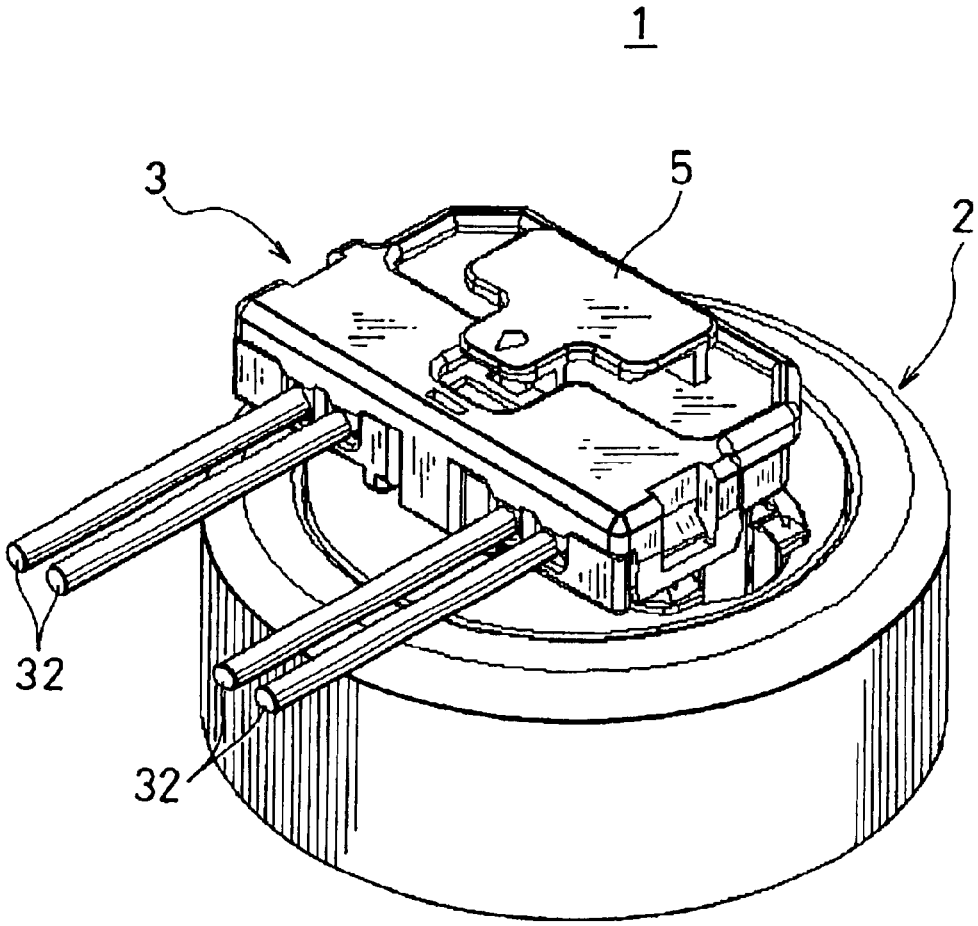
FIG. 1 is a perspective view showing the entire structure of an electrical connector assembly according to an embodiment of the invention.

Referring to the accompanying drawings, there is shown in FIG. 1 the entire structure of a connector assembly or an electrical connector assembly 1 used with the airbag system. In this diagram, the connector assembly 1 comprising a plug 3 engageable with a socket 2 is shown in the engaged state.

The socket 2 is provided in the form of a part of an airbag igniter (which is sometimes referred to as a squib) to be electrically connected to an airbag system control system. There are provided two igniters, though their body portions are not shown in FIG. 1. The igniter is an explosive device which is burnt when sufficient electric energy is applied to it through two conducting wires 32 of each pair. The burning of the igniter triggers the gas generating material to be ignited and, as a result of this, the airbag is inflated.

Figure 2:
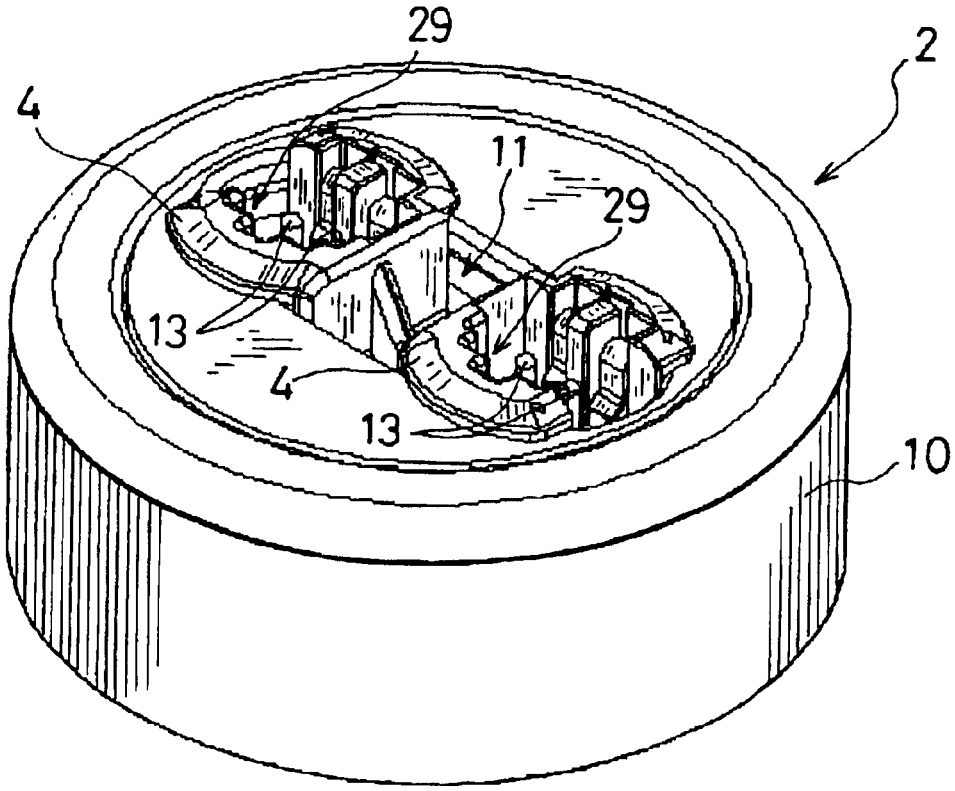
FIG. 2 is a perspective view of a socket and a short-circuit element of the electrical connector assembly according to the embodiment of the invention.

FIG. 2 shows the socket 2 which is in the state in which the plug 3 is disengaged from the electrical connector assembly 1. Two, integrally molded, short-circuit elements 4 are fitted in the socket 2 with a press-fit. The short-circuit elements 4 put contacts of the socket 2 into the short-circuited state until the socket 2 and the plug 3 are mechanically and electrically connected with each other.

Figure 8:
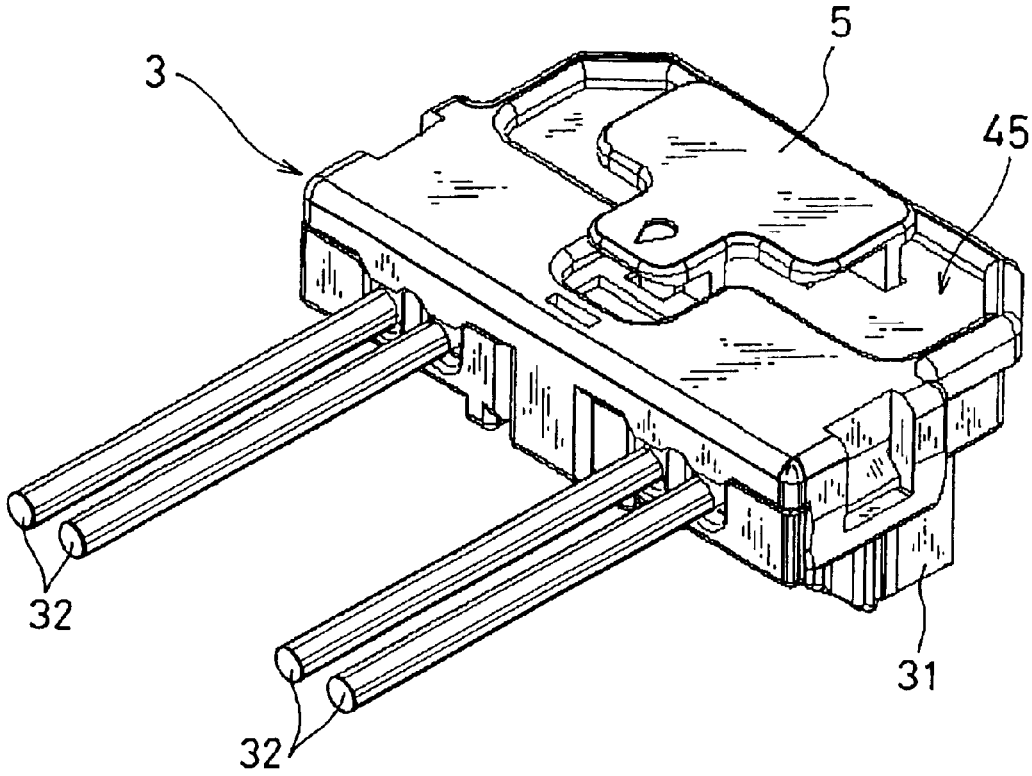
FIG. 8 is a perspective view of a plug of the electrical connector assembly according to the embodiment of the invention.

FIG. 8 shows the plug 3 electrically connected with the control system. The plug 3 is to be engaged in the socket 2. A locking element 5 is held in the plug 3 in its locked state in the first locking position shown in the diagram (hereinafter it is simply referred to as "the first position").

The functions and mutual relations of these various components will be clarified from the following description. As will be obvious from the following description, the plug 3, the short-circuit elements 4 and the locking element 5 are preferably formed of proper non-conductive plastic material, except various kinds of wires and contacts.

Figure 3:
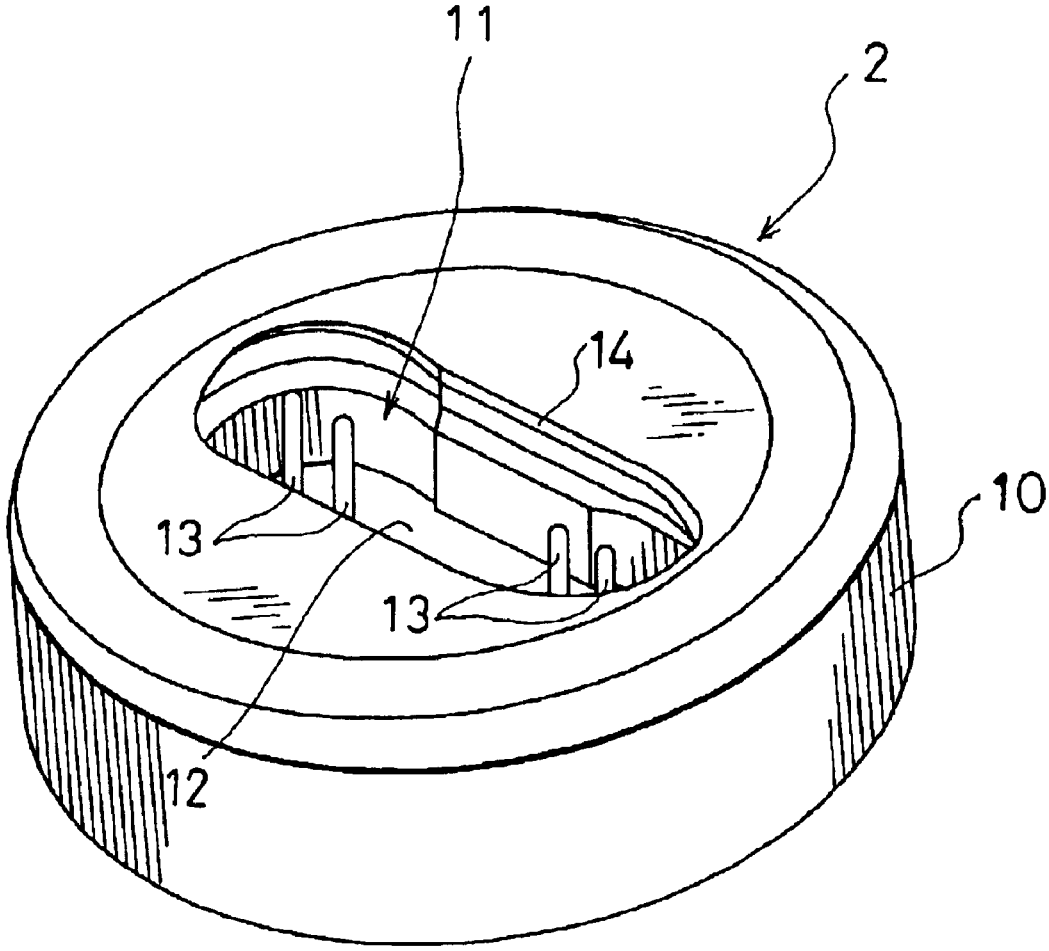
FIG. 3 is a perspective view of the socket of the electrical connector assembly according to the embodiment of the invention.

Referring first to the socket 2, the socket 2 is formed to have a cylindrical body 10 forming therein an accommodating portion 11 of a slot-like form for accommodating the two short-circuit elements 4. This socket 2 is well shown in FIGS. 1–3, in particular. The body 10 forming the accommodating portion 11 therein can be directly built in its related structure such as an igniter housing. Further, the accommodating portion 11 may be formed as a separate element so that it may be added to its related structure. In either configuration, the body 10 forming the accommodating portion 11 therein terminates at a bottom wall 12, as best shown in FIG. 3. Extended from the bottom wall 12 are two pairs of first conductive male electrical connector elements or pins 13 formed of metal. The socket 2 serves to support the two pairs of pins 13 in proximity so that the two pairs of pins, two for each pair, can all be arranged in series. These two pairs of pins 13 are connected to their respective conducting wires of two airbag igniters (not shown) in any conventional manner. The igniters are electrically energized through these pins 13 so that they can be ignited. As well shown in FIG. 3, the accommodating portion 11 of slot-like form is formed to have such a configuration that its outer circumferential part is partly folded inside at only one side of the part extending in the direction of the major axis of the slot. Also, the plug 3 is made to have the configuration and dimension corresponding to those of the outer circumferential part of the accommodating part 11, so as to prevent inadequate engagement between the socket 2 and the plug 3.

Figure 13:
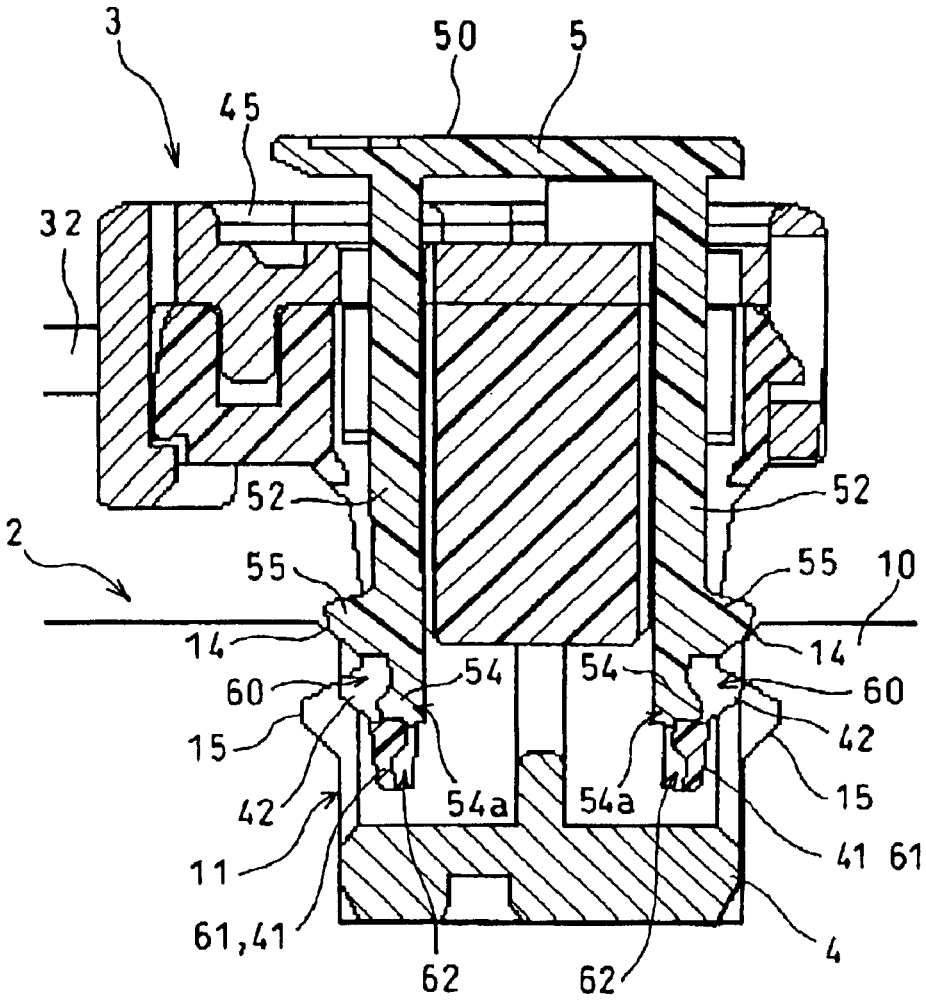
FIG. 13 is a sectional view showing an intermediate engagement state of the plug into the socket of the electrical connector assembly according to the embodiment of the invention.
Figure 14:
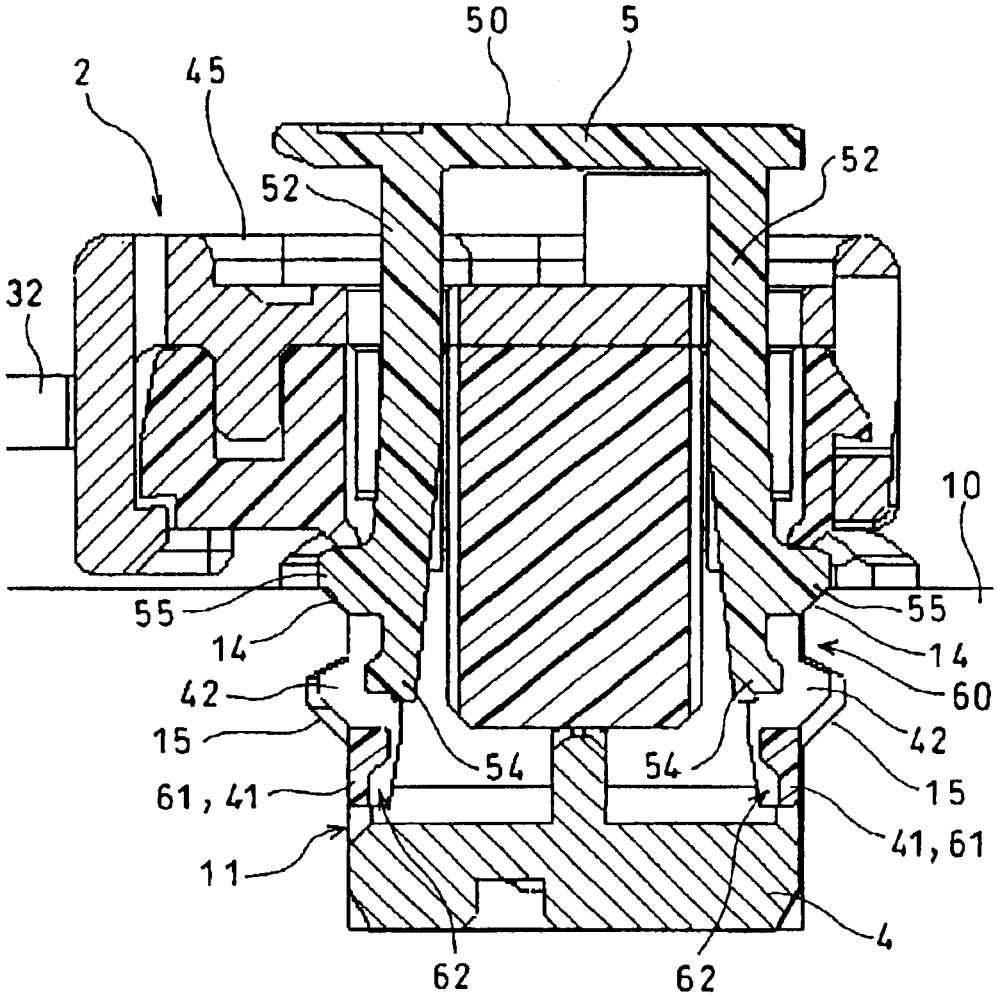
FIG. 14 is a sectional view showing an intermediate engagement state of the plug into the socket of the electrical connector assembly according to the embodiment of the invention.
Figure 15:
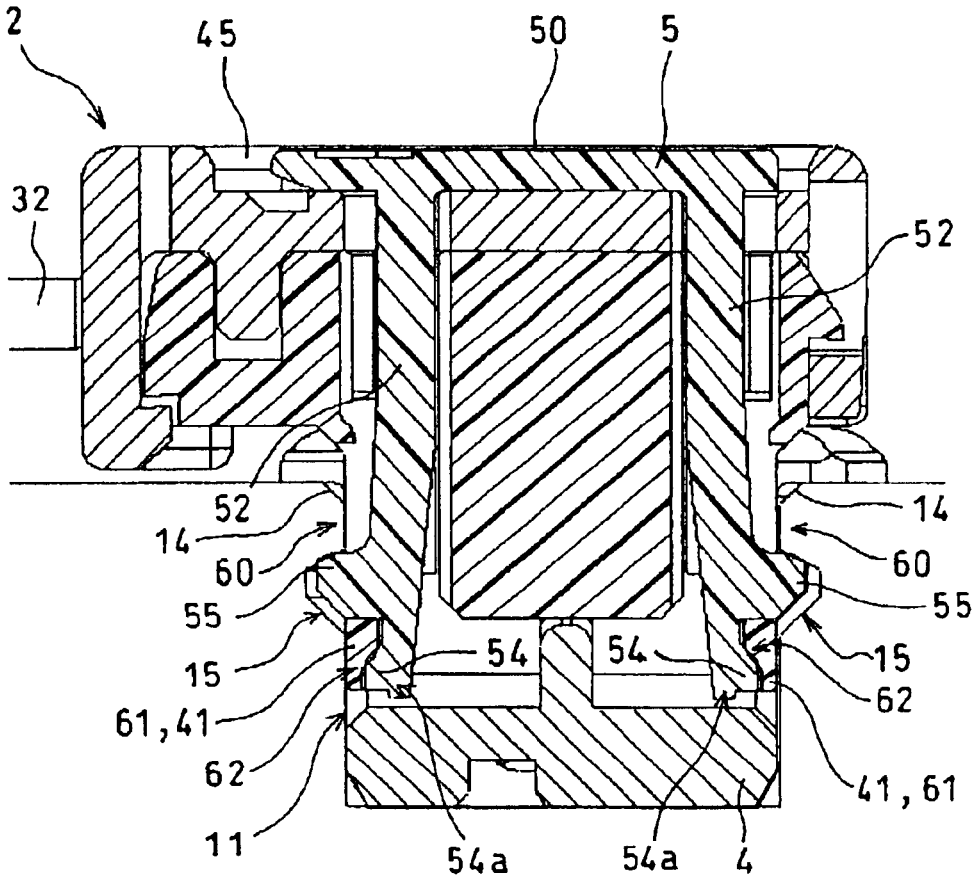
FIG. 15 is a sectional view showing a complete engagement state of the plug into the socket of the electrical connector assembly according to the embodiment of the invention.

The accommodating part 11 has an inclined surface 14 formed at an entrance thereof. Also, the accommodating part 11 has a locking recess 15 formed in its inner surface to extend continuously in the circumferential direction. This configuration is well shown in FIGS. 12–15, for example. These figures show the electrical connector assembly 1 in section taken along line extending in parallel with the conducting wires 32 lying in the middle of the space between the two pairs of conducting wires 32. As will be understood well from these figures, the inclined surface 14 serves to receive locking portions 42 provided at elastic legs 41 of the plug 3, as mentioned later, and produce a deforming moment to move the locking portions 42 toward the center (See FIGS. 12, 13). Further, the inclined surface 14 serves to receive second locking portions 55 of the locking element 5, as mentioned later, and produce a deforming moment to move the second locking portions 55 toward the center (See FIG. 14). The locking recess 15 serves to receive the locking portions 42 of the plug 3 and keep it in its engaged state, as best shown in FIG. 14. Also, the locking recess 15 serves to receive the second locking portions 55 of the locking element 5 and switch the locking element 5 to the second locking position (hereinafter it is simply referred to as "the second position"), as best shown in FIG. 15.

Referring second to the two short-circuit elements 4, the two short-circuit elements 4 are received in the accommodating portion 11, to be engaged with the plug 3. During the time during which the locking element 5 of the plug 3 does not assume the second position, the electrical connection is provided. Thus, the two short-circuit elements 4 serve to short-circuit the two pairs of pins 13 of the first male electrical connector elements.

As well shown in FIGS. 2 and 4–7, each of the two short-circuit elements 4 has a plastic body 16 of a generally cylindrical shape having a dimension to tightly fit and supported in the accommodating portion 11. The two short-circuit elements 4 are formed in one piece, such that they are continuously connected with each other via a bridge portion 17. The bridge portion 17 is provided with a reinforcing rib 19. The two short-circuit elements 4 have in their bodies 16 two openings 18, respectively, to receive the plug bodies 31 for supporting the two electrical terminals 30 of each pair which are the second male electrical connector elements of the plug 3 mentioned later. The two pairs of pins 13 are also extended passing through these two openings 18. The two openings 18 are formed to open to tops thereof and lateral sides thereof opposite to the side on which the bodies 16 are connected with each other via the bridge portion 17, respectively.

Figure 4:
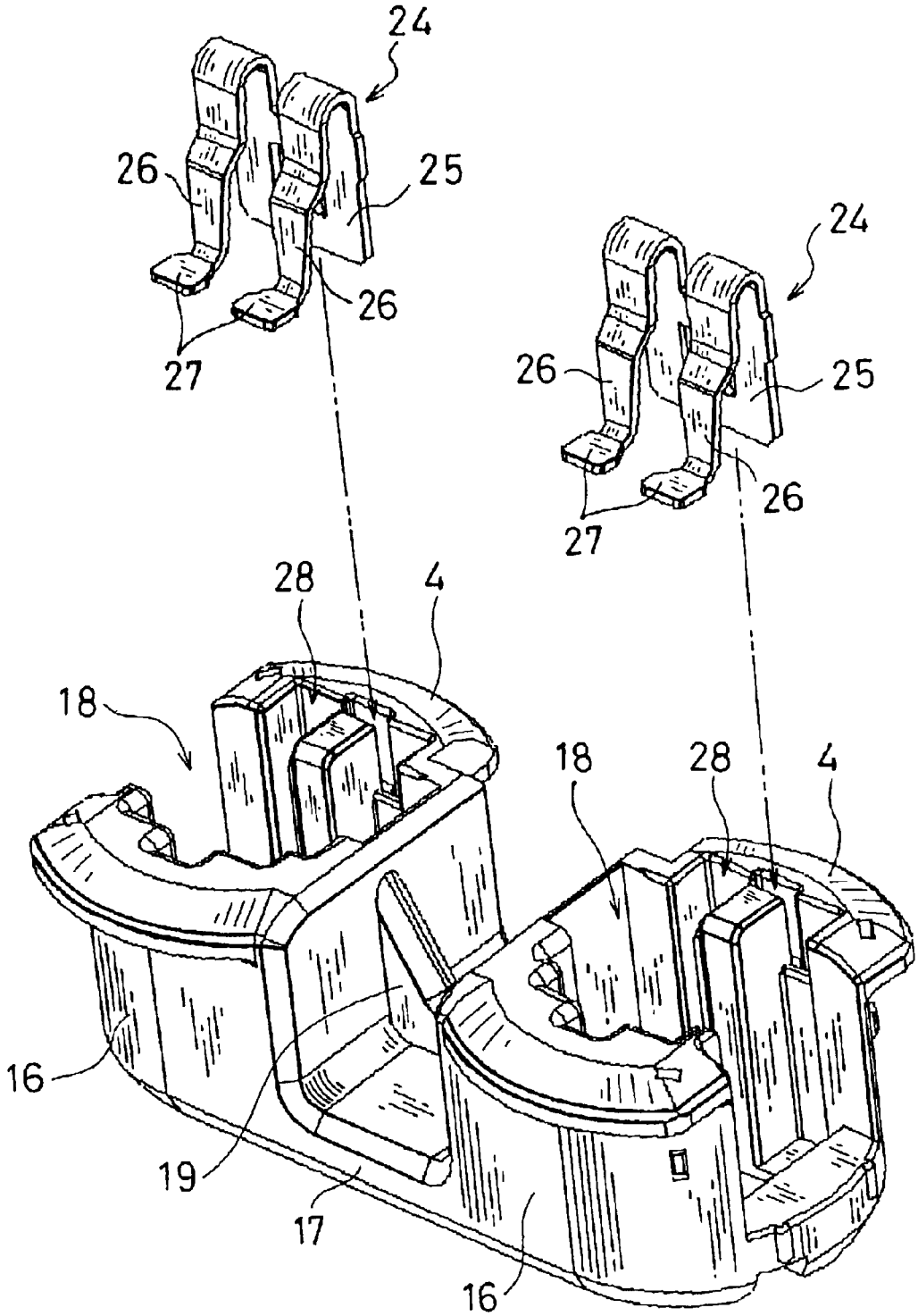
FIG. 4 is a perspective view of the short-circuit element of the electrical connector assembly according to the embodiment of the invention.
Figure 5:
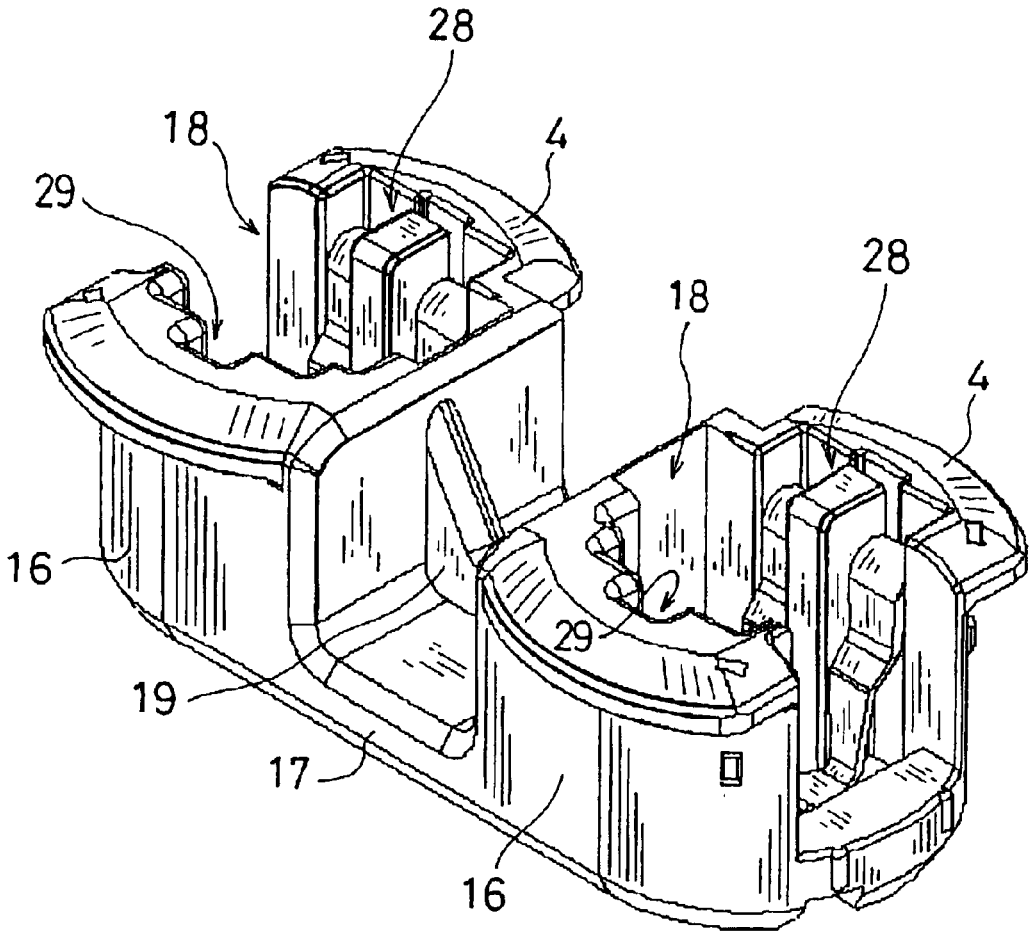
FIG. 5 is a perspective view of the short-circuit element of the electrical connector assembly according to the embodiment of the invention.
Figure 6:
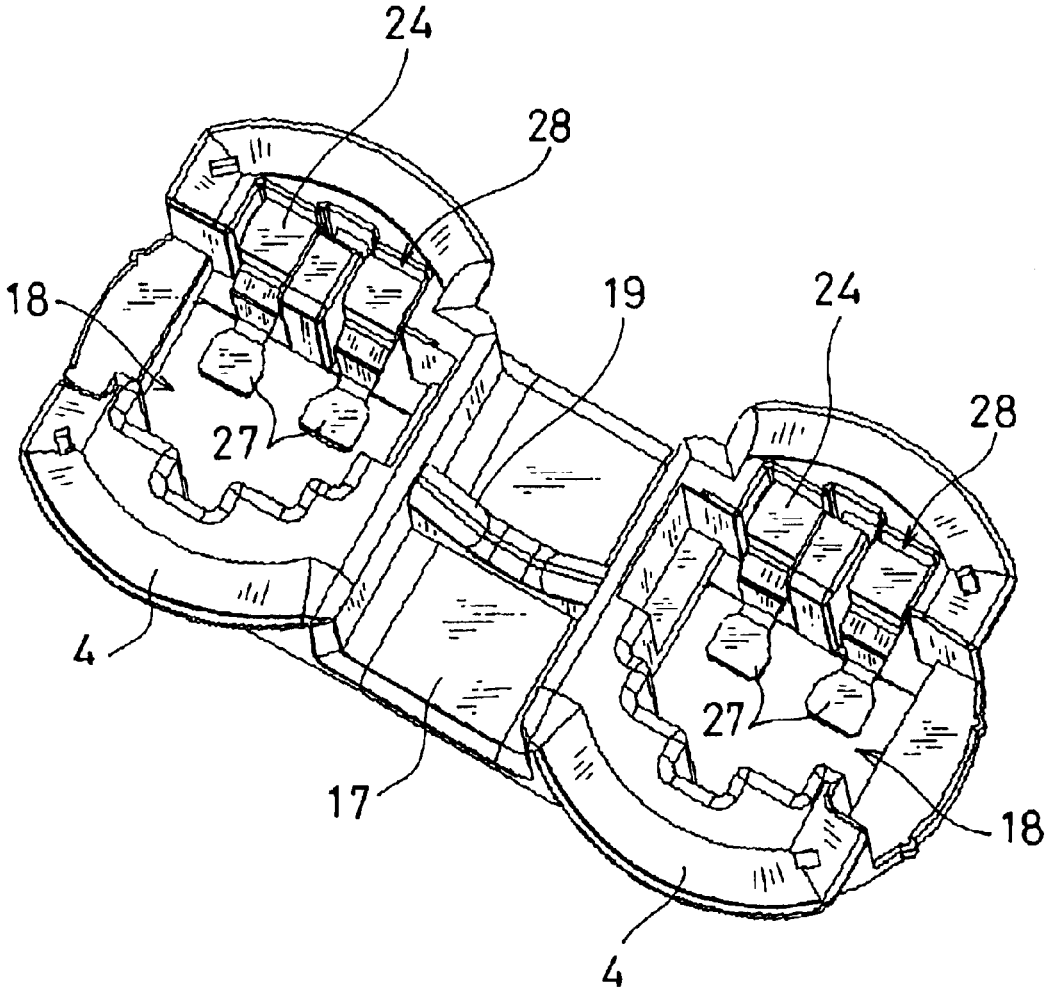
FIG. 6 is a perspective view of the short-circuit element of the electrical connector assembly according to the embodiment of the invention.
Figure 7:
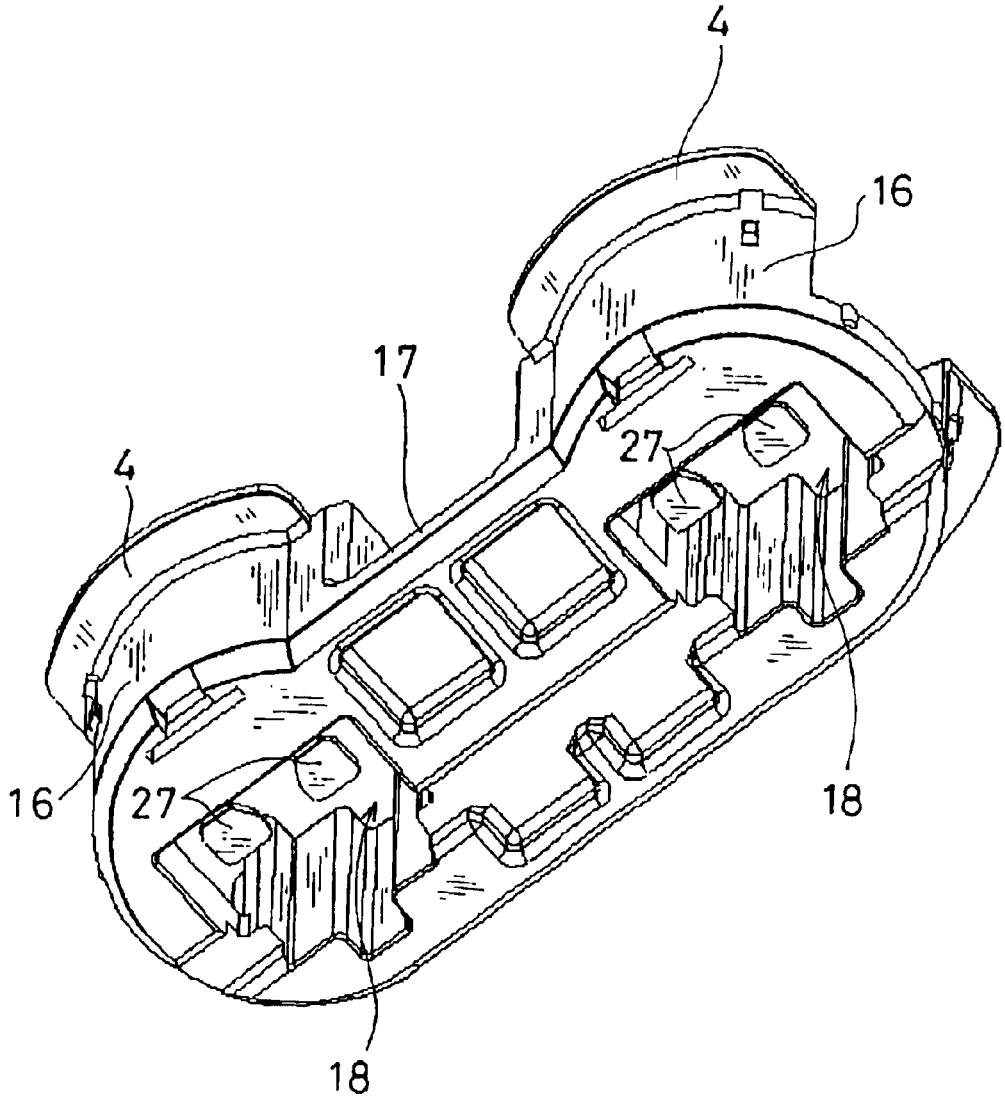
FIG. 7 is a perspective view of the short-circuit element of the electrical connector assembly according to the embodiment of the invention.

The two short-circuit elements 4 have short-circuit clips 24, respectively. FIG. 4 shows the state of the short-circuit clips 24 before being inserted into the related short-circuit elements 4. FIG. 5 shows the state of the short-circuit clips 24 after being inserted into the related short-circuit elements 4. FIGS. 6 and 7 show the short-circuit elements 4 as viewed from the top and bottom thereof, respectively. As well shown in these figures, the short-circuit clips 24 are held in the bodies 16 of the two short-circuit elements 4, respectively. The short-circuit clips 24 are formed of conductive material having elasticity such as spring steel. The short-circuit clips 24 are partly deflected to the direction of their abutting with the both pins 13. The abutment of the short-circuit clips 24 with the pins 13 provides an electrical short-circuit therebetween.

As best shown in FIG. 4, each of the two short-circuit clips 24 comprises a plate-form base 25, a pair of legs 26 folded back at the top of the base 25 and extending downward therefrom and a pair of abutting portions 27 folded at an angle of 90 degree at the lower portions of the pair of legs 26. Each of the legs 26 is folded and deflected stepwise in the direction of its being away from the base 25. The abutting portions 27 of the short-circuit clips 24 are brought into abutment with lateral sides of the pins 13 located at the corresponding positions, to electrically connected therewith. As will be well understood from FIGS. 5 and 6, the short-circuit clips 24 are held in the bodies 16 of the short-circuit elements 4, with their bases 25 inserted in slit-like recesses 28 of the short-circuit elements 4 so as not to slip off.

Figure 16:
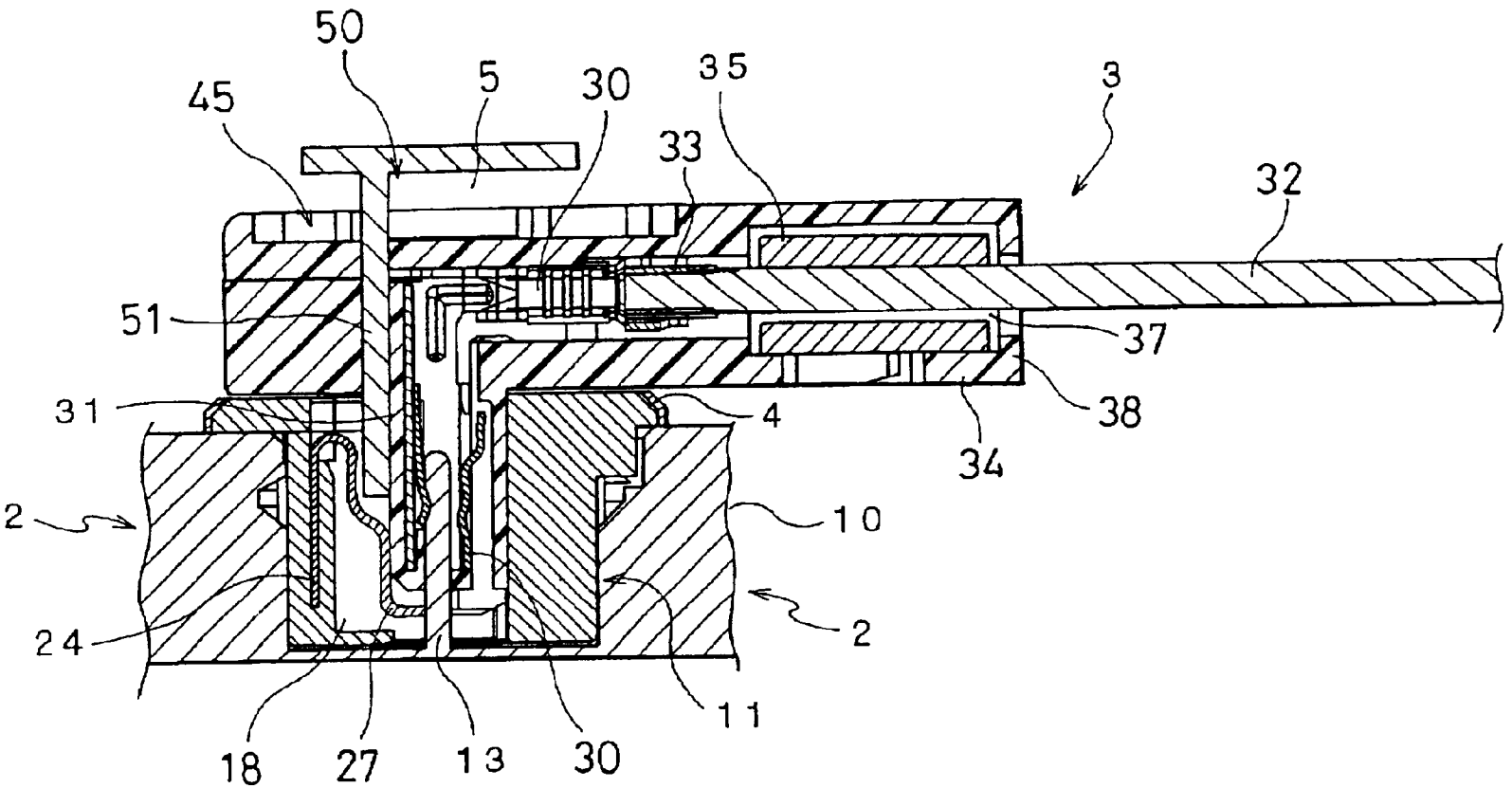
FIG. 16, which corresponds to FIG. 14, is another sectional view showing the intermediate engagement state of the plug into the socket.
Figure 17:
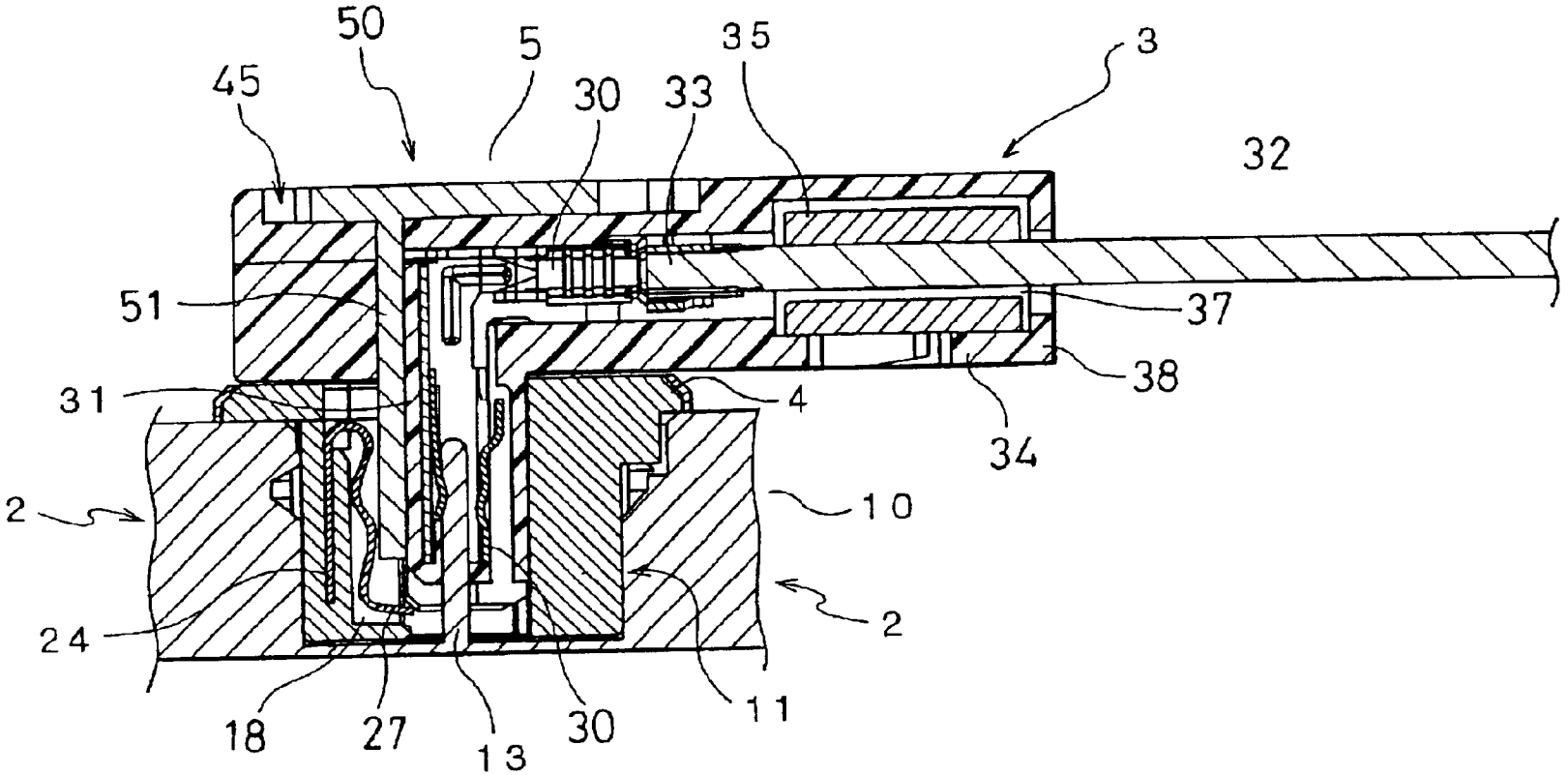
FIG. 17, which corresponds to FIG. 15, is another sectional view showing the intermediate engagement state of the plug into the socket.

FIGS. 16 and 17 show the electrical connector assembly 1 in section taken along any plane including the conducting wire 32 and the pin 13. These figures show the short-circuit element 4 accommodated in the accommodating portion 11 and the pin 13 extending upwardly within the opening 18. FIG. 16 shows the state in which the pin 3 is in abutment with the abutting portion 27 of the short-circuit clip 24 and thus is in electrical connection with it. FIG. 17 shows the state wherein legs 26 of the short-circuit clips 24 are bent by plugging the locking element 5 mentioned later and thereby the electrical connection between the abutting portion 27 of the short-circuit clip 24 and the pin 13 is released.

Figure 9:
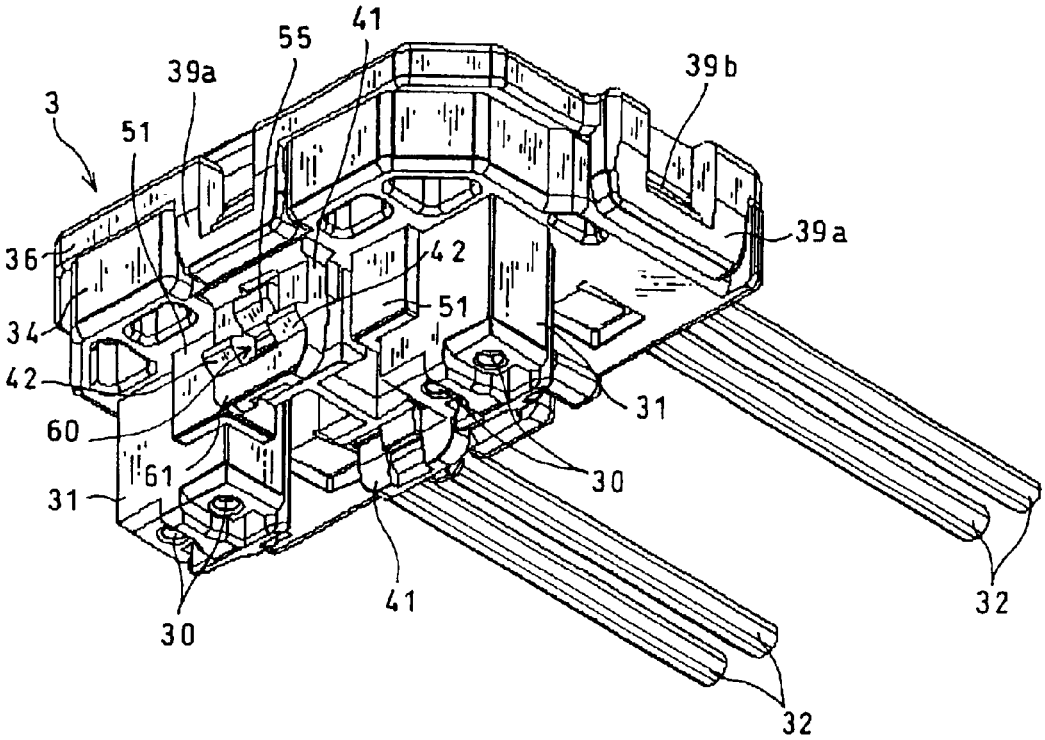
FIG. 9 is a perspective view of the plug of the electrical connector assembly according to the embodiment of the invention.
Figure 10:
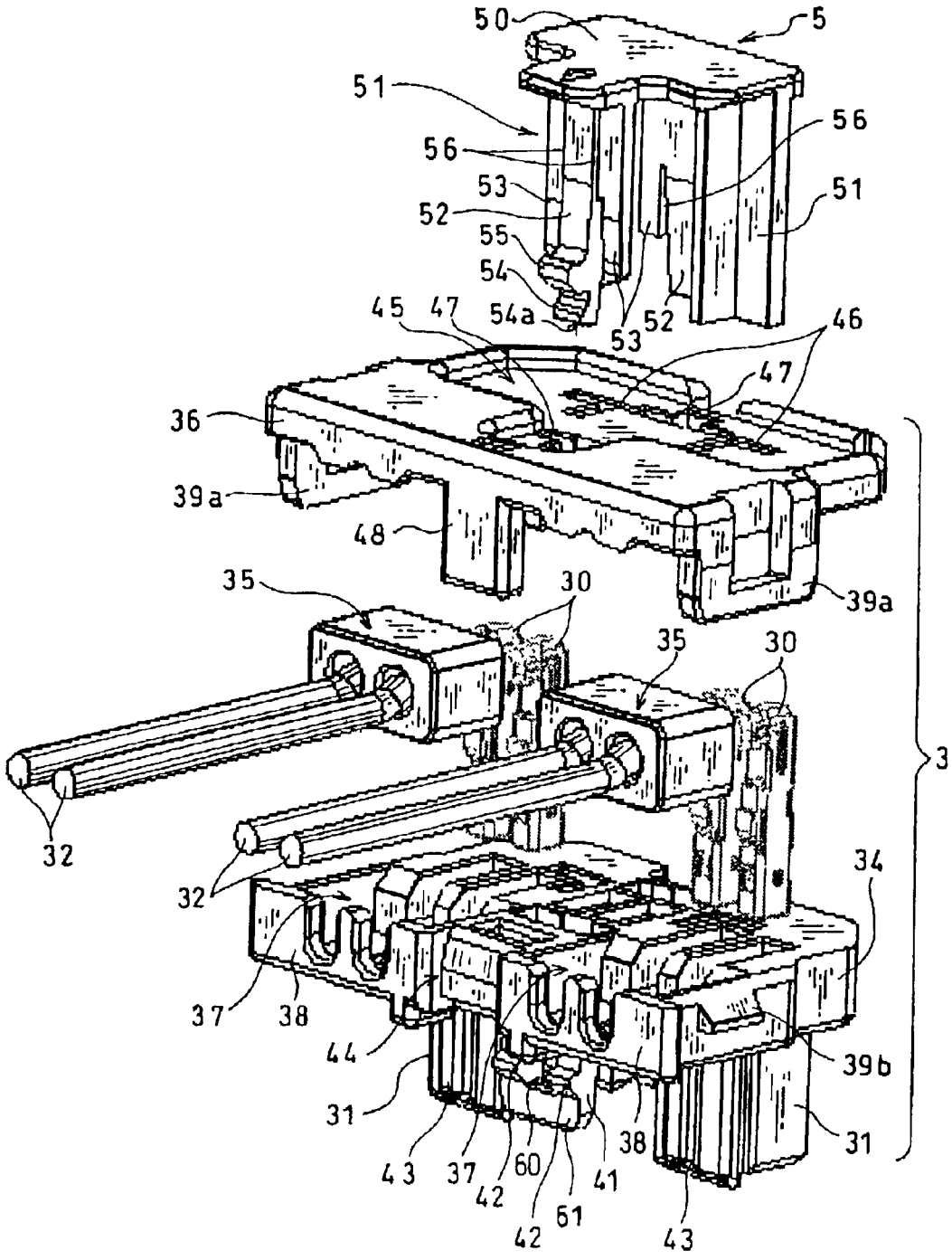
FIG. 10 is an exploded perspective view of the plug of the electrical connector assembly according to the embodiment of the invention.

Referring third to the plug 3, the structure of the plug 3 will be better understood from FIGS. 8–10 and 16. FIG. 8 is a perspective view of the plug 3 as viewed from the top; FIG. 9 is a perspective view of the plug 3 as viewed from the bottom; and FIG. 10 is an exploded perspective view of the plug 3. As shown in these figures, the plug 3 includes a plug body portion 31 extending downwardly and supporting two pairs of electrical terminals 30, two electrical terminals for each pair, which are in the form of second female electrical connector elements. These two pairs of electrical terminals 30 are electrically connected with the two pairs of conducting wires 32. Also, these two pairs of electrical terminals 30 are engaged with the two pairs of pins 13 or first male electrical connector elements, respectively, so as to be electrically connected therewith. Each pair of electrical terminals 30 are supported as a unit by the plug 3. Also, the electrical terminals 30 are formed to have configuration and size to receive the pins 13 therein and are mounted to extend in parallel with each other.

As well shown in FIGS. 10 and 16, the two electrical terminals 30 of each pair built in the central plug portion 31 each have a conducting wire connecting portion 33 for connecting one of the conducting wires 32. The conducting wire connecting portions 33 are provided in the electrical terminals 30 at their portions which extend from the tubular terminal portions forming the second female connector element and change in direction in a generally L-form. The conducting wires 32 are the insulation armored wires. Insulating coatings of the conducting wires 32 are peeled at the ends thereof so as to be electrically and mechanically attached to the conducting wire connecting portion 33 to which the conducting wires are connected. The attachment of the wires is usually performed by press-fitting a part of the conducting wire connecting portions 33 around the bare wires at the ends thereof in any conventional manner. The two pairs of conducting wires 32 pass through ferrite beads 35 placed in a box-shaped room 37 formed at a lower portion 34 of the plug 3. The bead 35 is a generally box-shaped homogeneous substance used for providing the noise filtering out function. Each bead 35 has two tubular thru holes extending in parallel with each other, through which the conducting wires 32 pass. The conducting wires 32 are extended out from an end of the lower portion 34, passing through an opening of a rear wall 38 of the room 37.

Figure 11:
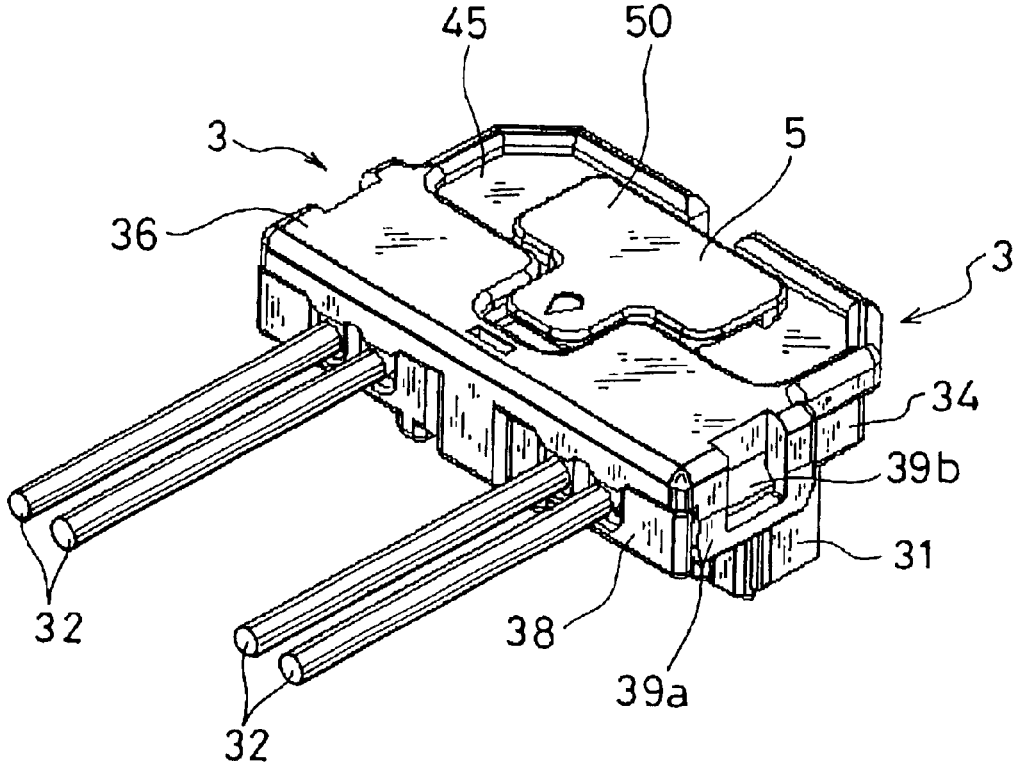
FIG. 11 is a perspective view of the plug of the electrical connector assembly according to the embodiment of the invention.

The lower portion 34 of the plug 3 is provided, at a bottom side thereof, with two plug bodies 31 of a generally square cylinder shape and two elastic legs 41. The two elastic legs 41 are disposed between the two plug bodies 31, such that a generally cross-shape is formed by a line connecting between the two elastic legs 41 and a line connecting between the two plug bodies 31. The two elastic legs 41 have, on their outside surfaces, locking portions 42 to be engaged in the locking recess 15 formed in the inside of the accommodating portion 11, as previously mentioned, and the locking portions 42 are formed by outwardly protruding lugs (See FIGS. 9, 10 and 11). The locking portions 42 are so located and sized as to be fitted in the locking recess 15 when the plug 2 is adequately engaged with the socket 2.

The two plug bodies 31 are so located and sized as to provide frames having enough rigidity for the plug 3 to be disposed in the accommodating portion 11 formed in the socket 2. As shown in FIG. 10, the plug bodies 31 have ridges 43. The ridges 43 are so sized and located as to be engaged with recesses 29, as shown in FIGS. 2 and 5. The engagement between the ridges 43 and the recesses 29 ensures the correct connection between the electrical terminals 30 of the plug 3 and the pins 13 of the socket 2.

As best shown in FIG. 10, the plug 3 further has an upper portion 36 that covers end portions of the conducting wires 32 and the beads 35 and engages with the lower portion 34. The upper portion 36 and the lower portion 34 are combined into a general rectangular parallelepiped shape by engagement of a pair of locking portions 39*a*, 39*b* which are provided in two opposite side surfaces of the upper and lower portions, respectively. The upper portion 36 and the lower portion 34 are locked in their properly engaged state by the engagement between the pair of locking portions 39*a*, 39*b*. The upper portion 36 has downwardly extending projections 48 which are so sized and located as to fit in concave portions 44 formed in the side surfaces of the lower portion 34. The projections 48 subserve to position the upper portion 36 with respect to the lower portion 34.

As well shown in FIGS. 8 and 10, the upper portion 36 of the plug 3 has a wide shallow recess 45 formed in an upper surface thereof at a corresponding location over the plug bodies 31. A pair of first perforated openings 46, which are arranged opposite to each other in a generally L-shape with respect to the sides of the plug bodies 31, are formed in the recess 45 at both widthwise sides thereof. A pair of second perforated openings 47, which are arranged opposite to each other in a generally T-shape, such that a generally cross-shape is formed by a line connecting between the pair of first perforated openings 46 and a line connecting between the pair of second perforated openings 47, are formed in the recess 45 at both lengthwise sides thereof. When the related portions of the locking element 5 are inserted in these perforated openings 46, 47, the locking element 5 is supported by the central plug portions 31. The locking element 5 is locked at the first position. This locking will be further mentioned later.

Finally, reference is given to the structure of the locking element 5. In FIG. 10, the locking element 5 includes a head portion or pressing portion 50, a pair of first legs 51 extending substantially in parallel with each other and a pair of second legs 52 extending substantially in parallel with each other. The pair of first legs 51 are formed to extend downwardly from both widthwise sides of the pressing portion 50. The pair of first legs 51 each have a cross section of a generally inverted L-shape. The pair of first legs 51 serve to release the short circuits between the two pairs of first electrical connecter elements 13 when the plug 3 and the socket 2 are engaged with each other. The locking element 5 is inserted in the plug 3, with their inverted L-shaped legs fitted in the pair of perforated openings 46, respectively (See FIG. 8). The pair of first legs 51 are so sized and located as to allow two sides of each of the inverted L-shaped legs to be inserted along two sides of each of the plug bodies 31.

In FIG. 10, the pair of second legs 52 are arranged at such locations that a generally cross-shape is formed by a line connecting between the pair of first legs 51 and a line connecting between the pair of second legs 52 and are formed to extend downwardly, respectively. The pair of second legs 52 have the locking portions formed to project outwardly. The locking portions each have a first locking portion 54 and a second locking portion 55 which are vertically arranged in the ascending order. The first locking portion 54 is formed to project outwardly to a small extent and the second locking portion 55 is formed to project outwardly to a large extent. The first locking portion 54 has, at its front end, a step portion 54*a* (See FIG. 12). The provision of the first locking portion 54 enables the locking element 5 to be locked at the first position with respect to the plug 3 and the socket 2, and the provision of the second locking portion 55 enables the locking element 5 to be locked at the second position with respect to the plug 3 and the socket 2. The pair of second legs 52 each have two restraint portions 53 which are formed at both lateral sides thereof to extend downwardly in parallel with each other.

FIGS. 12–15 show the electrical connecter assembly 1 in section taken along the plane including the pair of second legs 52 of the locking element 5. As will be well understood from FIGS. 9, 10 and 12 of these figures, step portions 61 are formed at lower end portions of openings 60 of the elastic legs 41 of the plug 3. When the locking element 5 is pressed in the plug 3, the step portions 54*a* of the second legs 52 are brought into abutment with the step portions 61 of the elastic legs 41 and thereby are put into the locked state at the first position. At this time, the second locking portions 55 of the locking element 5 come to project outwardly from the opening 60 and thus are put in the operable state. The elastic legs 41 each have an inwardly hollowed locking recess 62 formed in its interior at the lower end portion thereof. When an outward projecting portion of the first locking portion 54 of the locking element 5 shifted from the first position is engaged in the locking recess 62, the locking element 5 is locked in the second position. The locking element 5 is locked in the second position to an extent that can permit the locking element 5 to be restored to the first position when it is pulled up from the plug 3.

As well shown in FIG. 10, the restraint portions 53 at both lateral sides of the second legs 52 are spaced from the second legs 52 via the slits 56, so as not to hinder the elastic deformation of the second legs 52. Also, the restraint portions 53 are tapered so that their thicknesses are gradually decreased toward the lower ends. When the locking element 5 is inserted in the plug 3, the restraint portions 53 are placed on the inside of the elastic legs 41, respectively. When the locking element 5 is in the locked position of the first position, the deformation of the elastic legs 41 toward the inside of the locking portions 42 is not restrained by the restraint portions 53. On the other hand, when the locking element 5 is shifted to the second position, the restraint portions 53 are placed in position with their thicknesses decreased. This provides the result that when the locking portions 42 are made to disengage from the locking recess 15, they comes into abutment with the restraint portions 53, so that the locking portions 42 are prevented from being disengaged from the locking recess 15. However, in the normal, space is left between the restraint portions 53 and the elastic legs 41, and as such can ensure that the locking element 5 is smoothly shifted from the first position to the second position.

The locking element 5 thus constructed can be allowed to be locked in the first position with respect to the plug 3 and also can be allowed to be shifted to the second position where the two short-circuit clips 24 of the two short-circuit elements 4 are simultaneously moved back to their non-short-circuit positions when the plug 3 is engaged with the socket 2. This action of the short-circuit clips 24 moving back to their non-short-circuit positions will be well understood from FIGS. 16 and 17. Specifically, the locking element 5, when pressed in from the first position to the second position, allows the first legs 51 to be advanced up to the folded portions of the short-circuit clips 24, and as such can allow the abutting portions 27 to move away from the pins 13 to release the electrical short-circuit connection with the pins 13. Thus, the locking element 5 can allow the socket 2 and the plug 3 to be engaged with each other in such a manner as to prevent them from being separated from each other; can allow them to be electrically connected with each other; and can further allow the short circulation provided by the two short-circuit elements 4 to be released simultaneously. As a result of this, the structure of the electrical connector assembly having these characteristic features can be realized with ease.

Now, connecting operation of the electrical connector assembly 1 described above will be described with reference to FIGS. 1, 2, 8 and 11–17. As shown in FIG. 2, the two short-circuit elements 4 are previously fitted in the accommodating portion 11 of the socket 2 to short-circuit the two pairs of pins 13. On the other hand, as well understood from FIGS. 8 and 12, the locking element 5 is previously locked in the first position with respect to the plug 3 or is previously locked, with the first locking portions 54 abutted with the step portions 61. At this time, as shown in FIG. 8, the head portion 50 of the locking element 5 remains spaced from the recess 45 of the plug 3, and this state of the connecter assembly can be visually checked.

Figure 12:
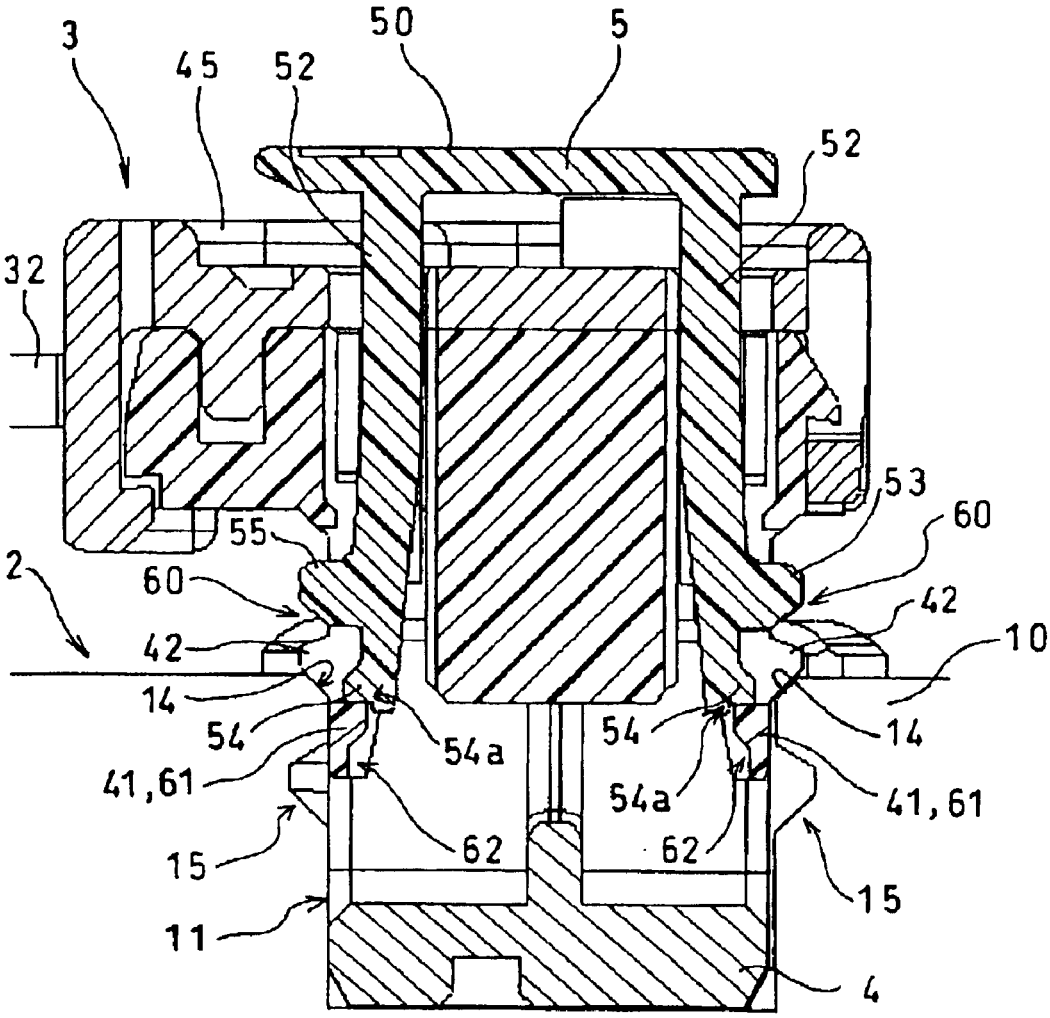
FIG. 12 is a sectional view showing an initial engagement state of the plug into the socket of the electrical connector assembly according to the embodiment of the invention.

Then, with two sides of the top and bottom portions 34, 36 of the plug 3 gripped by hand, parallel portions of the elastic legs 41 at the bottom are inserted in the accommodating portion 11 of the socket 2, the state of which is well shown in FIG. 12. At this time, the locking portions 42 of the elastic legs 41 are in abutment with the inclined surface 14 at the entrance of the accommodating portion 11 and remains at rest. When the head portion 50 of the locking element 5 is pressed from this state by a thumb for example, an inward moment acts on the elastic legs 41. This inward moment causes the elastic legs 41 and the second legs 52 to be deflected inwardly, as shown in FIG. 13, so that the locking portions 42 of the elastic legs 41 are fitted in the locking recess 15. At this time, the restraint portions 53 of the locking element 5 are placed in their upper position, not to restrain the elastic legs 41 from being deformed.

As shown in FIG. 14, at the point of time at which the locking portions 42 of the elastic legs 41 are fitted in the locking recess 15, the second locking portions 55 of the locking element 5 are in abutment with the inclined surface 14 at the entrance of the accommodating portion 11, and the first locking portions 54 of the second legs 52 are away from the step portions 61 of the elastic legs 41. At this point of time, since the inward moment acts on the second legs 52, when the head portion 50 of the locking element 5 is continuously pressed, the locking element 5 is lowered further.

Then, the second locking portions 55 of the second legs 52 are fitted in the locking recess 15, as shown in FIG. 15, and the locking element 5 is set in the second position in which the first locking portion 54 of the second legs 52 are locked in the locking recess 62. Also, the restraint portions 53 of the locking element 5 are placed in position with their thicknesses decreased, though not shown, to restrain the locking portions 42 from being disengaged from the locking recess 15. As a result of this, the plug 3 is prevented from being disengaged from the socket 2. In the second position, the head portion 50 of the locking element 5 is sunk in the recess 45 of the plug 3, as well understood from FIG. 11, from the state of which one can visually check that the mechanical engagement between the socket 2 and the plug 3 is perfectly completed.

FIG. 16 shows the state that the socket 2 and the plug 3 are in engagement with each other before the locking element 5 is pressed further. In this state, the front ends of the first legs 51 of the locking element 5 do not reach step-like folded portions of the short-circuit clips 24 at intermediate portion thereof, so that the abutting portions 27 are still in abutment with the side surfaces of the pins 13 to keep the short-circuit condition. Then, the locking element 5 is pressed further and is brought into complete mechanical engagement, the state of which is shown in FIG. 17. In FIG. 17, the step-like folded portions of the short-circuit clips 24 at intermediate portions thereof are stretched by the front ends of the first legs 51 of the locking element 5. As a result of this, the abutting portions 27 are moved away from the side surfaces of the pins 13 to release the short circuit between the pins 13, and the electrical engagement is also ended completely.

As will be understood from above, the direction for the plug 3 to be engaged with the socket 2 is identical with the direction for the locking element 5 to be shifted from the first position to the second position. This can provide the result that the engagement of the plug 3 with the socket 2 and the shifting of the locking element 5 from the first position to the second position can both be performed in the same pressing motion of the locking element 5. Thus, the mechanical engagement between the plug 3 and the socket 2 and the electrical connection therebetween can be completely ended in the single motion. Once the mechanical engagement of the plug 3 in the socket 2 is completed, it becomes impossible to take out the plug 3 from the socket 2, unless only the locking element 5 is returned back to the first position from the second position.

As described above, according to the electrical connector assembly 1 according to the illustrated embodiment, the socket 2 is constructed to support the two pairs of first electrical connector elements 13 in proximity. This can eliminate the need to arrange the two sockets while making a position adjustment to bring the electrical contacts of each pair into alignment in series in each of the sockets, thus providing the result of facilitating the effective use of the connection space.

Also, since the plug 3 is constructed to support the two pairs of second electrical connector elements 30 as a unit, the double action commonly required for the engagement of the connector assembly can be reduced in half to the single operation.

Further, since the socket and the plug can be engaged with each other in only a limited orientation, the need to distinguish the two connector assemblies by using different colors or shapes for the purpose of preventing improper connection of the two connector assemblies is eliminated to begin with. In addition, the need to check the fitting positions of the connector assemblies is eliminated to begin with. Thus, in addition to reducing a component count, additional works, such as the color coding, and the checking work of the fitting positions can be cut.

Also, since the integrally formed locking element 5 can allow the two short-circuit elements 4 to move back to their non-short-circuit positions simultaneously, the release of short-circuit can be completed in only a single operation.

Thus, the present invention can provide an electrical connector assembly having a locking part that can provide a drastically improved working efficiency and thus provide excellent connection workability even when two pairs of electrical contacts are connected with each other.

In addition, according to the electrical connector assembly 1 according to the illustrated embodiment, since the two short-circuit elements 4 are also integrally formed as a unit, possible mistakes, such as the case that the two separate short-circuit elements may be wrongly assembled, can be prevented. Besides, the assembling work of the short-circuit elements 4 can be completed in only a single operation, and as such can provide an electrical connector assembly having a locking part of excellent in workability. Also, since the plug 3 is constructed to be received in the openings 18 of the integrally formed short-circuit elements 4, the stable connecting structure can be provided for even the connector assembly having two pairs of electrical connector elements.

Further, according to the electrical connector assembly 1 according to the illustrated embodiment, when the locking element 5, which is previously locked at the first position with respect to the plug 3, is pressed down, the plug 3 is engaged with the socket 2 and also the locking element 5 locked at the first position is released simultaneously and then is pressed further into the second position. The locking element 5 operates to release the short-circuit of the short-circuit element 4 when it is in the second position. In other words, the connecting operation of the plug 3 and the socket 2 and the pressing operation of the locking element 5 to release the short circuit of the short-circuit elements 4 can be performed in the same motion as a whole.

While the present invention has been described on its preferred embodiment, it is to be understood that it is intended to cover in the appended claims all variants, modifications, applications and equivalents thereof that will be obvious as fall within the scope of the appended claims upon reading and understanding the specification.

For example, the pair of legs 26 of the short-circuit clip 24 may be presented in the form of a sheet of plate. The pair of abutting portions 27 formed by bending the front ends of the legs 26 at an angle of 90 degree may take any suitable configuration to directly contact with the pins 13, without limiting to the configuration as shown in the illustrated embodiment.

Also, as long as the two short-circuit elements 4 are formed in one piece, the two short-circuit elements 4 may be formed into any suitable configuration, without limiting to the configuration wherein the two short-circuit elements 4 are connected to each other via the bridge portion 17, as in the illustrated embodiment. For example, the two short-circuit elements 4 may be formed into an elliptic cylinder form or a like form.

In addition, the locking element 5 according to the present invention is applicable not only to the electrical connector assembly 1 according to the present invention that is so structured that the locking and the release of the short circuit can both be performed in the same motion, but also to a conventional type of electrical connector assembly that is so structured that the locking and the release of the short circuit are performed by different motions.

What is claimed is:

1. An electrical connector assembly used for an airbag system having two igniters for an airbag, for energizing and igniting a gas generator to inflate the airbag the electrical connector assembly comprising:

a socket for supporting two pairs of first electrical connector elements in proximity;

a plug for supporting two pairs of second electrical connector elements which are to be engaged with the two pairs of first electrical connector elements, respectively;

two short-circuit elements, fitted in the socket for electrically short-circuit the two pairs of first electrical connector elements, respectively; and a locking element which is locked at a first position with respect to the plug thereby engaging the socket at the first position and, when the plug is engaged in the socket, becomes moveable to a second position at which the locking element forces the two short-circuit elements to move back to their non-short-circuit positions simultaneously.

2. The electrical connector assembly according to claim 1, wherein the two short-circuit elements to short-circuit the two pairs of first electrical connector elements are integrally formed and having openings to receive the two pairs of second electrical connector elements, respectively.

3. An electrical connector assembly used for an airbag system having two igniters for an airbag, for energizing and igniting a 255 generator to inflate the airbag the electrical connector assembly comprising:

a socket for supporting two pairs of first electrical connector elements in proximity;

a plug for supporting two pairs of second electrical connector elements which are to be engaged with the two pairs of first electrical connector elements, respectively;

two short-circuit elements, fitted in the socket for electrically short-circuit the two pairs of first electrical connector elements, respectively; and a locking element which is locked at a first position with respect to the plug thereby engaging the socket at the first position and, when the plug is engaged in the socket, becomes moveable to a second position at which the locking element forces the two short-circuit elements to move back to their non-short-circuit positions simultaneously, wherein a direction for the plug to be engaged in the socket is identical with a direction for the locking element to move from the first position to the second position, so that the engagement of the plug in the socket and the movement of the locking element from the first position to the second position can be continuously performed in the same pressing motion of the locking element.

4. An electrical connector assembly comprising:

a socket for supporting two pairs of first electrical connector elements in proximity;

a plug for supporting two pairs of second electrical connector elements which are to be engaged with the two pairs of first electrical connector elements, respectively;

two short-circuit elements, fitted in the socket for electrically short-circuit the two pairs of first electrical connector elements, respectively; and a locking element which is locked at a first position with respect to the plug and, when the plug is engaged in the socket, becomes moveable to a second position at which the locking element forces the two short-circuit elements to move back to their non-short-circuit positions simultaneously;

wherein the locking element has a pair of first legs extending substantially in parallel with each other and a pair of second legs extending substantially in parallel with each other, wherein the pair of first legs are to short-circuit the two pairs of first electrical connector elements, and the pair of second legs, which are disposed at such locations as to form a generally cross-shape by a line connecting between the pair of first legs and a line connecting between the pair of second legs, having locking portions to be locked at the first position and the second position with respect to the plug and the socket.

* * * * *